United States Patent [19]

Post

[11] 3,930,910

[45] Jan. 6, 1976

[54] BLASTING COMPOSITION CONTAINING AN ALKANOL

[76] Inventor: John R. Post, P. O. Box 1134, Littleton, Colo. 80120

[22] Filed: Mar. 18, 1974

[21] Appl. No.: 451,825

Related U.S. Application Data

[62] Division of Ser. No. 311,935, Dec. 4, 1972, Pat. No. 3,810,425.

[52] U.S. Cl. ..... 149/21; 149/47;89

[51] Int. Cl.[2] ..... C06B 45/02

[58] Field of Search ..... 149/47, 21, 89

[56] References Cited

UNITED STATES PATENTS 3,765,966 10/1973 Edwards ..... 149/47 X

*Primary Examiner*—Stephen J. Lechert, Jr.

*Attorney, Agent, or Firm*—Mason, Kolehmainen, Rathburn & Wyss

[57] ABSTRACT

Crushed ammonium nitrate fueled with the proper nitropropane lower alcohol mix is a non cap-sensitive, field-mixable blasting agent that produces two to four times the detonation pressure obtainable with AN/FO, when loaded to densities between 1.10 and 1.55 by use of a simple over-hole mechanical device.

10 Claims, 3 Drawing Figures

BLASTING COMPOSITION CONTAINING AN ALKANOL

Figure 1:
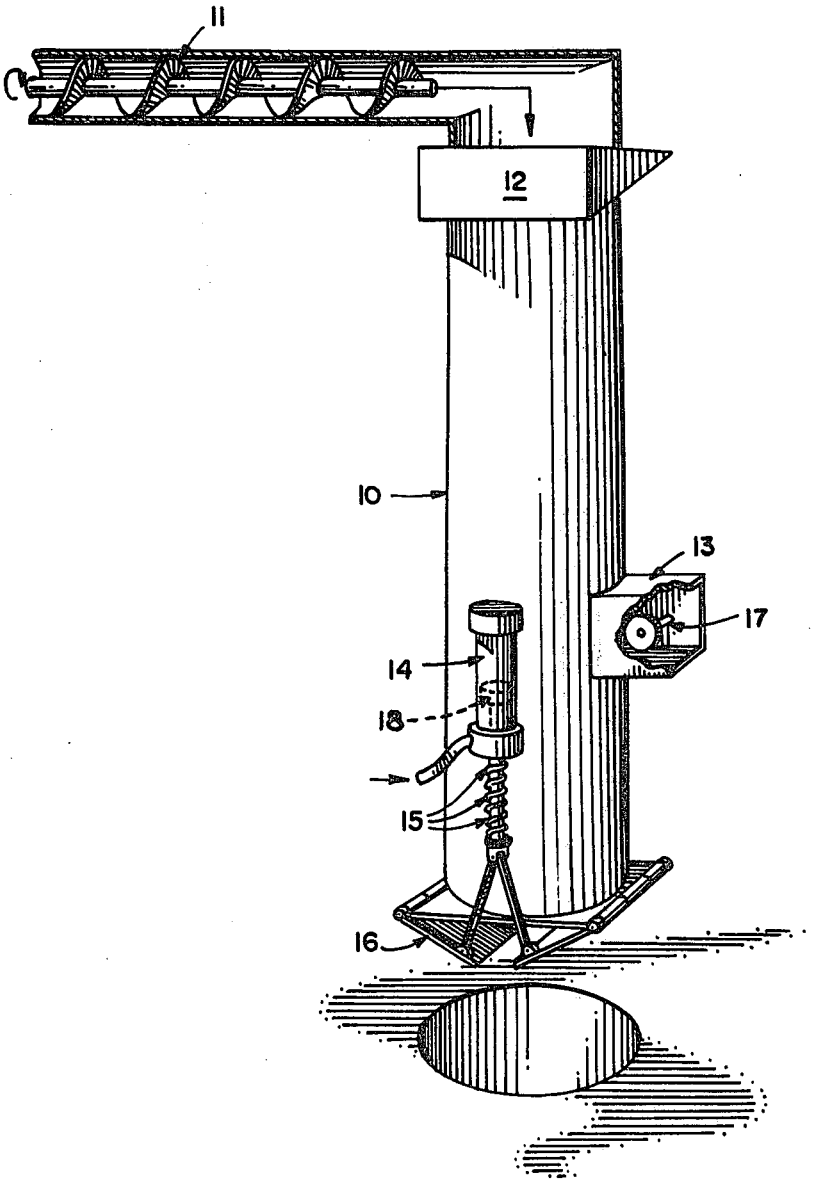

This is a division of application Ser. No. 311,935, filed Dec. 4, 1972, now U.S. Pat. No. 3,810,425.

The invention relates to explosive compositions of improved power and safety, and to a device used to densify the explosive composition at the blasting site just before and as the composition is loaded into a pre-drilled hole. More particularly, this invention relates to a blasting agent composed of ground ammonium nitrate, nitropropane and an alcohol containing from one to five carbon atoms, and apparatus for mixing the components into a damp slug of blasting agent which can be dropped down a hole to produce a high density explosive of improved brisance.

BACKGROUND OF THE INVENTION

In the use of explosives, the need for safety is a problem which is ever present with workers in the field. Many explosives used in the field are compounded into a finished form at the factory and shipped from there to the point of use. During shipment, special precautions must be taken. Frequently, these precautions involve limitations on the routing of the explosives and the type of carrier, etc. Further, there are limitations as to the manner in which the explosives can be shipped and stored.

As a result of these requirements regarding shipping, storage, etc., dynamite and other sensitive explosives are quite expensive to ship and store. This is reflected by a relatively high cost for the explosive material which must be borne by the ultimate user.

Some years ago, the commonly used blasting material for general industrial and commercial use, such as quarrying or earth-work blasting, or the like, was dynamite. In recent years, dynamite has been largely displaced by relatively simple mixtures of ammonium nitrate with sensitizers such as diesel oil. While the latter has met with wide acceptance, the commonly used mixtures are not without some disadvantages.

The explosive most commonly used is prilled ammonium nitrate fueled with fuel oil or similar liquid hydrocarbon, and sometimes supplemented with smaller amounts of other ingredients — the generic term for this composition is AN/FO.

AN/FO has accounted for perhaps two-thirds or more of the industrial explosives used during 1971, up from practically zero 15 years ago. To gain such acceptance, it had to have had several factors in its favor. Paramount was economics which is a price/performance relationship; second was its ease of handling in bulk, which has lowered the cost of loading holes to an almost irreducible minumum; third was its uniformity of performance, which has permitted almost instantaneous acceptance and widespread use.

But AN/FO's uniformity is also its major disadvantage from the standpoint of bulk loading densities and resultant borehole pressures. One of the serious disadvantages of ammonium nitrate/fuel oil type explosives is excessive low density that leads to low borehole pressure. For example, AN/FO with a ratio of ammonium nitrate to fuel oil of 94/6 has a density of about 0.8 gm/cc with a corresponding borehole pressure usually less than 140 tons/sq. in. (19 kilobars). Thus with AN/FO mixtures, drilling costs are abnormally high — and shovel costs are frequently higher than normal, because low detonation pressure causes reduced fragmentation which necessitates closer drilling of holes. Therefore, the low cost of AN/FO is somewhat offset by higher drilling and shovel costs.

There has been little impovement in AN/FO loading densities since bulk loading of holes was first done over 10 years ago. There have, however, been many attempts to overcome this disadvantage, which attempts have been unsuccessful from either an economic or a modis operandi standpoint.

Users and producers of AN/FO have tried various methods of improving bulk loading densities, such as grinding, weight additives and special downhole loading equipment. It was thought that grinding would increase the density since the finer particles could fill the void spaces between the spherical prills. But grinding has resulted in little or no improvement of density.

At first I attributed the lower field densities to the feathering action on the blasting agent by the discharge screw conveyor, and it was thought this effect could be overcome by loading material in 10 to 50 pound batches. This method resulted in a slight improvement, but with insufficient additional performance to offset handling problems.

It has been found that the reason for the inability to achieve higher bulk loading densities using ground ammonium nitrate is because of a phenomena which I call "fluffing." Because of this fluffing, the ammonium nitrate never actually has a chance to become dense and compact enough to produce the desired detonation velocity.

Fluffing occurs when ground ammonium nitrate having less than 9 percent liquid fuel therein falls to the bottom of the hole, "bounces" off of the bottom and thereby is dispersed with the air in the bottom of the hole. After bouncing, the ground ammonium nitrate settles as a fluffy mass of low (0.80 –0.85 gm/cc) density. Batches of ground AN/FO having the usual 6 percent fuel oil were dropped 20 feet into large diameter Lucite pipe and the materials were observed to rebound off the bottom and settle as a fluffy low-density mass. After discovering the problem, I set out to find a solution to this density problem while keeping the explosive non-cap-sensitive. On the assumption that wetter material would be more cohesive and result in higher densities, mixtures using 9 percent to 18 percent fuel oil were tested. These gave higher densities, but as expected, the various mixtures either detonated at low-order or failed to detonate.

FIELD OF THE INVENTION

A liquid fuel has been found which when added to crushed ammonium nitrate, supplies energy of its own which makes up for the ammonium nitrate which it replaces and which supplies oxygen needed to obtain sufficient brisance upon detonation. This fuel can be added to crushed ammonium nitrate in an amount up to 16 percent is sufficient to impart the necessary cohesive compaction to the blasting agent.

It was unexpectedly found that a fuel comprising nitropropane (either 1-nitropropane or 2-nitropropane) meets the requirements of safety, economics — both price and performance, ease of handling in bulk, and uniformity of performance, when it is diluted with proper amounts of a lower $C_{1-5}$ alcohol. These two nitropropanes are isomers and have almost identical physical properties and are interchangeable for mixing the ammonium nitrate as disclosed herein. Most nitriles such as acrylonitrile, acetonitrile can be used in place of the nitropropane but are usually undesirable because of hazards involved.

Fuel admixtures supply combustible materials that utilize the oxygen released during the decomposition of ammonium nitrate. Although erroneously referred to as "sensitizing" the nitrate, the presence of a fuel merely increases the temperature of the reaction above the critical required to propagate a detonation.

Nitropropane contributes additional heat and energy to a blasting agent, but no explanation is offered except that nitropropane contains a +5 valence nitrogen. The only explanation for the feasibility of using acrylonitrile or acetonitrile is the presence of the C ≡ N group. In the 1.10 to 1.55 density range, ground ammonium nitrate fueled only with nitropropane to oxygen-balance, yields detonation pressures of 60 to over 100 kilobars — about a 10 percent reduction from theoretically ideal for AN/FO; however, the mixture is cap-sensitive. If oxygen-balance is maintained and the proper diluent is used, the nitro-propane portion of the fuel mix can be reduced to about 50 percent before a 10 percent reduction in detonation pressure is noted, provided the density is greater than 1.0. Fortunately, a 50/50 nitropropane lower alcohol mix improves economics immensely and the sensitivity of blasting agents fueled therewith is well within the desired limits. This 50/50 fuel mix allows considerable human error in the field, since a 20 percent increase or decrease from an oxygen-balanced mixture does not lower detonation pressure more than about 20 percent providing loading densities are maintained at the lower fuel levels. While the 50/50 nitropropane/$C_{1-5}$ alcohol mixture is preferred from a convenience standpoint, when each component is added in an amount of 5–9 percent of the total blasting agent (10–18 percent total fuel), excellent results are achieved.

ZERO IDEAL OXYGEN BALANCE

This fuel can be added in a percentage which can result in an explosive with an ideal oxygen balance of zero, or as close to zero as desired.

The term "oxygen balance" used in the specification and claims is well known and accepted by the art. The oxygen balance of an explosive compound is calculated by determining the total weight of the compound and dividing this weight into the difference between the weight of the oxygen required to completely oxidize the elements of the compound and the weight of the oxygen actually present in the compound. An explosive having perfect balance to yield carbon dioxide and water has zero balance, one lacking sufficient oxygen has a negative balance, and one containing excess oxygen has a positive balance. For an excellent discussion of oxygen balance, see Chemical Reviews, Vol. 44, pages 419–445 (1949). The most effective explosives have oxygen balances which approach zero. All classes of explosives have their greatest brisance, power and heat of explosion at zero oxygen balance (see the graphs in Chemical Review cited above).

The oxygen balance of the nitroparaffins is very low; for nitromethane it is —39.3 percent; for nitroethane —96 percent; and for nitropropane —134.8 percent. If the oxygen balance in the final explosive composition is too low, difficulty in affecting detonation is experienced. For this reason, whenever a nitroparaffin having as low an oxygen balance as nitropropane was mixed with ammonium nitrate in the prior art, another component was combined which had a higher oxygen balance percentage (see the Lawrence U.S. Pat. No. 2,325,064). It was generally believed that nitromethane having an oxygen balance of —39.3 percent could not be replaced by nitropropane having an oxygen balance of —134.8 (i.e. see the Brower U.S. Pat. No. 3,255,057) especially when mixed with methanol having an oxygen balance of —150. However, it was unexpectedly found herein that this substitution can be made provided the proper percentages of nitropropane and lower alkanol are added to the ammonium nitrate and the ammonium nitrate be crushed.

In prior art techniques where a fuel of a nitroparaffin and a diluent were added to ammonium nitrate, it was thought essential that the ammonium nitrate be low density, high porosity, uncrushed prills i.e. see col. 3 of 3,133,844. It was thought essential that the fuel migrate from the exterior surfaces of the prills into their interior portions, necessitating the use of a high-porosity prill. The invention disclosed herein, on the contrary, does not produce the desired and unexpected results unless the ammonium nitrate is crushed.

Ideal oxygen balances of about zero can be achieved when methanol and ethanol are used by utilizing the following formulas prepared especially for utilization in conjunction with the composition of the instant invention to ascertain the corresponding percentages of nitropropane and alkanol for a zero oxygen balance. As previously disclosed, equal quantities of nitropropane and alkanol or an amount of each between 5 percent and 9 percent of the total composition gives an exceptionally good mixture.

When methanol is used, the fraction of nitropropane and methanol to be mixed with ground ammonium nitrate to obtain an oxygen balance of approximately zero can be calculated according to the following formula $$X = \frac{20 - 170Y}{154.8}$$

where X = fraction of nitropropane and Y = fraction fo methanol. Of course the fractions X and Y can vary between values of 0.05 and 0.09. Oxygen balances of zero can be obtained with values of X and Y outside of the 0.05 and 0.09 range, but the unexpected detonation velocities and detonation pressures are not achieved thereby, or cap-sensitivity problems encountered.

Experiment were performed with various combinations of 1–17 percent of each component. The total amount of fuel must be between 10 and 18 percent of the total blasting agent so that the necessary cohesive compaction can be obtained. These percentages (1–17 percent of each component with 10–18 percent total fuel) can be used, but lower detonation pressures or cap-sensitivity problems are encountered when not within the 5–9 percent range for each fuel component.

For example, a 6 percent nitropropane value (X = 0.06) and a 6.33 percent methanol value (Y = 0.0633) gives an oxygen balance of about zero.

The formula for ethanol to achieve an approximately zero oxygen balance is:

Ethanol: $$X = \frac{20 - 228.7Y}{154.8}$$ $X$ = fraction of nitropropane; $Y$ = fraction of ethanol A zero oxygen balance cannot be achieved when propanol is used in the 5–9 percent range but a zero oxygen balance can be achieved within the 1–5 percent and 9–17 percent ranges, and for percentages of propanol and nitropropane very close to the lower limit (5 percent) of the 5–9 percent range which gives best results.

For propyl, isopropyl, butyl, isobutyl, pentyl and isopentyl alcohols, an approximately zero oxygen balance can be obtained by using percentages of nitropropane to alcohol according to the formulas:

| | | |
|---|---|---|
| Propyl or Isopropyl alcohol | $X = \frac{20 - 260Y}{154.8}$ | $X$ = fraction of nitropropane; $Y$ = fraction of $C_3$ alcohol |
| Butyl or Isobutyl alcohol | $X = \frac{20 - 279.4Y}{154.8}$ | $X$ = fraction of nitropropane; $Y$ = fraction of $C_4$ alcohol |
| Pentyl or Isopentyl alcohol | $X = \frac{20 - 299.1Y}{154.8}$ | $X$ = fraction of nitropropane; $Y$ = fraction of $C_5$ alcohol |

By using amounts of propanol and nitropropane within the 5–9 percent range, very good results are obtained although the oxygen balance is not ideal.

BLASTING COMPOSITION

To achieve best results, the blasting composition disclosed herein comprises 5–9 percent nitropropane; 5–9 percent lower alkanol having from 1 to 5 carbon atoms; and the remainder 82–90 percent crushed ammonium nitrate.

There are four basic types of ammonium nitrate readily available in quantity. They are: a low-density, high-porosity prill; a high-density, low-porosity prill or grain produced by a graining process; a high density, high-porosity prill, and a high-density, low-porosity nitrate cake that has been crushed to approximate prill size. The low-density, high-porosity has heretofore thought to have been a must when the ammonium nitrate is fueled because of the necessity of retaining fuel and "effective" small grain size due to porosity. High-density nitrates yield lower energy because of inability to retain fuel necessary for oxygen-balance and because of a large effective grain size. However, some uncrushed high-density nitrate is used in AN/FO, but only in large blastholes, and always with a high-powder factor and the risk of poor performance.

When all four types were crushed to similar screen analysis and fueled with the same nitropropane-diluent mix, performance was in the same bracket. Desired densities were harder to obtain with the low-density type, probably due to lower particle density and tendency to fluff. The high-density nitrate is therefore preferred. It has been found that the porosity is not so important when the nitrate is crushed for density purposes, since there is adequate surface area for adsorption of liquid fuel and grain size is reduced accordingly.

Best results are achieved by crushing with one of the commercial grinders which, when crushing prills, leaves less than 7 percent uncrushed prills. However, as long as 10–18 percent of the fuel described herein is added to the ammonium nitrate, it has been found that up to 60 percent uncrushed prills (+20 mesh) can be used together with at least 40 percent crushed and still achieve detonation at densities within the range of 1.1–1.55 gm/cc.

Ground ammonium nitrate produced by a roll crusher is flakey, while a hammermill product has irregular shapes and a wider size distribution. When fueled with a nitropropane/diluent mix, desired densities were easier to obtain with the hammermill product. However, at the same densities and nearly identical screen analysis, results were in the same performance bracket. The method used to grind the ammonium nitrate is not critical as long as the in-hole density of 1.10–1.55 gm/cc can be achieved with the fueled ground product according to this invention. In practice, any commercial grinder can be used, i.e. that used with the bulk delivery apparatus of the Knotts U.S. Pat. No. 3,531,022. The ammonium nitrate can be ground at the blasting site as by using the bulk delivery apparatus of the Knotts patent, or can be preground and delivered to the blasting site as a ground material.

It is well known that AN/FO can be made cap-sensitive by grinding, with the degree of sensitivity dependent on the fineness. Further, as the density is increased, a ground AN/FO becomes less sensitive; on the other hand, if density is decreased to the point of inadequate confinement, a detonation will not propagate even if it can be initiated.

The same is true for a finely ground nitrate fueled with nitropropane. That is, a prilled nitrate/nitropropane mix is not cap-sensitive, while a ground nitrate/nitropropane mix can be cap-sensitive, and the sensitivity is also dependent on density and fineness.

The cap-sensitivity of ground nitrate/nitropropane mixes can be negated by the addition of certain nitropropane diluents. Although varying amounts of several diluents negates cap-sensitivity, only one diluent meets the other requirements of high-energy performance, tolerance of human error, desired density and economics. The diluent is a lower alkanol having 1–5 carbon atoms. This particular diluent used at a 50 percent level of the fuel portion lowered detonation pressure about 10 percent from that attained without dilution.

When ground ammonium nitrate is mixed with nitropropane lower alkanol fuel over-hole, it is probably in its most insensitive state. During conveying to the collar of the slugger by, for example, an auger, the material is in small fluffed batches of about two pounds, with a high degree of void space within the batches. The diameter of the batches is less than the critical unconfined diameter, and the batches are separated by conveyor flights and even more void space. It is doubtful that even a cap-sensitive material could be initiated under the same conditions, but if initiated, propagation failure would surely result.

During the hole loading, the combination of materials loaded into the hole is only as safe as its most hazardous unit. In most operations, a cap-sensitive detonating cord is brought uphole from a cap-sensitive primer, usually wrapped around a rock and laid out on the ground in the immediate work area. Actually, there is no hazard as determined by an "anvil" test, where detonation in the cord is only in the area of immense impact without propagation along the cord.

BLASTING COMPOSITION HOLE LOADING

Loading methods used for downhole loading of bulk AN/FO are somewhat standard and all result in fairly uniform densities, with 50 percent of the charge being void space. Equipment for bulk hole loading of crushed nitrate-nitropropane-diluent mix is limited to those rigs using an auger system, since ground nitrate fueled to a moist condition will not flow through a pneumatic system. However, any method of mixing the nitropropane-alcohol components into the ammonium nitrate can be used. For high density loading of such a material, a simple mechanical device is used at the discharge end of the conveyor. The addition of fuel is done overhole and the crushing of the nitrate can be done either at the bulk storage location or overhole. There is excellent equipment, economically available, for overhole crushing as described in manufacturer's literature and U.S. Pat. No. 3,531,022. The fuel can be added at the auger intake.

Sensitivity, except as a safety measure in transporting, storing, and handling, is of little significance in the performance of a blasting agent, provided it is well confined and adequately initiated. The energy obtainable from a blasting agent is totally a function of the rate and quantity of gas generated and the heat of the explosion, instead of being related to the ease with which it can be detonated.

Hole diameter increases, up to about 6 inches, will result in increases in detonation velocity. The higher detonation pressures resulting therefrom will usually permit an increase in hole spacing to maintain the same powder factor at nearly the same stemming. But, if the hole size is increased over 6 to 7 inches, the increase in detonation pressure is insufficient to permit increased hole spacing without an increase in powder factor, because of the disproportional increase in energy requirements to fracture between holes.

The higher density of a ground nitrate-nitropropane-diluent mix permits smaller holes at the same powder factor used for AN/FO. However, economics dictates an increase in spacing to maintain the same powder factor and stemming, since much greater detonation pressure assures fracturing at a greater spacing—within limits, of course, and due to economics.

Prior art loading of blasting holes with prilled ammonium nitrate compositions, i.e. AN/FO, could only load to densities of 0.80 to about 0.85 gm/cc and usually detonate at a velocity between 11,500 and 12,000 ft/sec in 3 inches diameter charges. Such a load would only yield detonation pressures between 25 and 28 kilobars. With the composition and apparatus herein described, downhole densities between about 1.10 and 1.55 gm/cc can be achieved. In 3 inches diameter charges this gives velocities in the 14,000 to 17,000 ft/sec range and detonation pressures between 50 and 100 kilobars.

These detonation pressures, heretofore unobtainable with fueled ammonium nitrate, give exceptional fracturing results which are vividly illustrated when the dense composition described herein and AN/FO are each loaded into holes and comparatively detonated. A large "plume" of smoke and explosion gases rise above the AN/FO filled hole. This is because of the weak detonation pressures. When the explosion gases and shock waves are not strong enough to fracture, push and lift the earth around the point of detonation, the gases escape through the path of least resistance—back up through the hole. When the hole loaded with the dense blasting agent described herein is detonated, only a small plume is seen, and even that plume can be seen to be more a lifting of earth rather than a plume of gases. The gases from exploding the composition described herein have enough power to move the earth away in all directions and therefore very little gases funnel upward through the hole. It is important to note that while detonation velocity is a near linear function of the loading density, the detonation pressure increases as the square of the velocity. Obviously, the ability to achieve even a small increase in loading density produces momentous overall results.

THE COMPACTING APPARATUS

Once mixed, the explosive composition is added to a device as shown in FIG. 1. I call this device a "slugger" since it forms a "slug" of blasting composition which achieves a density of 1.10 – 1.55 gm/cc when dropped into the hole as described hereafter. The slugger can be attached to the end of the auger found on bulk hole loading apparatus used with the present AN/FO process (see 23 of FIG. 3).

As described above, because of "fluffing," crushed AN/FO — prilled ammonium nitrate and a liquid hydrocarbon, usually fuel oil — when added to a blasting hole only achieved a density of about 0.85–0.90 gm/cc. It has now been found, that by using the blasting composition as described above together with the slugger (FIG. 1), in-hole densities of 1.10–1.55 can be achieved. This required density of explosive composition is achieved by loading the composition in the slugger prior to dropping the slug into the hole. The slug is the cohesive compact mass of blasting composition having 10–18 percent fuel which is formed by the "slugger" and dropped into the drilled blasting hole.

The slugger is a compacting device (as shown in FIG. 1) which comprises a tubular member having a top end and a bottom end and having an inside diameter along the entire length of the tubular member. The inside diameter at the top end of the tubular member is smaller than the inside diameter at the bottom end of the tubular member. The slight tapering of the side walls of the slugger is critical in achieving unloading of the contents of the slugger in a uniform compact mass as is necessary to achieve an inhole blasting composition of the required density. The top end of the slugger can be provided with a collar to catch blasting composition falling from the bulk hole loading apparatus. The slugger need not have a circular cross section as long as the cross sectional area at the top is less than that at the bottom. For example, the cross section of the slugger can be eliptical, hexagonal octagonal, square, rectangular, or any convenient shape. The only necessary structure is that taking any two points along the length of the slugger, the transverse cross-sectional area at the higher point must always be less than at the lower point. The diameter of the tubular member can gradually and uniformly increase from the top end of the tubular member to the bottom end of the tubular member.

At the bottom end, the slugger must have a gate operatively attached thereto which gate has means operatively attached thereto for moving the gate to a closed position wherein the bottom end of the tubular member is substantially completely covered by said gate and blocked from passage of blasting composition therethrough, and to an open position wherein the bottom end of the tubular member is substantially completely unobstructed by said gate for free passage of blasting composition through the bottom end of the tubular member. Any means can be used to move the gate to either a completely obstructing or completely unobstructing position as described above. FIG. 1 is a specific embodiment of a slugger with a gate having a means for opening and closing the gate. The slugger has a hinged gate which has operatively attached thereto an air cylinder which is attached to a compressed air supply for opening and closing the gate. The gate is spring loaded to open. In operation, the gate is secured in a closed position by forcing the piston 18 within the air cylinder up toward the top of the slugger with compressed air. As the piston 18 moves upward, the spring 15, coiled around the piston, is placed under increasing compression.

When the gate has been closed with compressed air, as described above, the slugger is filled with blasting composition to the desired level. The air pressure is then released from the air cylinder which causes the gate to quickly open from the force of the spring under compression.

The specific embodiment shown in FIG. 1 is in no was intended to limit the invention herein described. The means used to open and close the gate at the bottom of the slugger is in no way critical. Any form of gate can be used and can be actuated to open and close in any way known in the art to open and close gates or valves. The gate can be hinged as shown in FIG. 1, or can be hinged from one side and latched closed on the opposite side of the gate. The gate can be slidably attached to the bottom end of the tubular member or can be positioned to cover the bottom end of the tubular member manually and quickly pulled away when the slugger is filled. Any method of opening and closing the gate can be used. The mechanism can be mechanical as shown in FIG. 1, or the gate moving mechanism can be electrical or electro-mechanical as known per se in the art.

The slugger is actually a catching or retaining device and can be provided with a sight slot or small window near the top of the tubular member so the slugger operator will know when the slugger contains the desired amount of blasting composition. At that time, the operator can actuate the gate opening means. The slug or compact cohesive unit of blasting composition substantially retains its cohesive compact shape during its entire downward flight to its point of rest within the hole.

The slugger can also be provided with sensing or control means which can actuate the gate mechanically, electrically or electro-mechanically in response to weight, gate or tubular wall pressure, or height of blasting composition. These sensing or control mechanisms are known per se in the art. Thus, a detailed description of such a sensing or automatic control mechanism is not set forth herein. Of course, the control means, if used, can be operatively attached to the slugger feed supply also so that the feed to the slugger can be automatically stopped prior to gate opening.

The critical required structural design which the slugger must have to be able to drop a compact slug of blasting composition into a predrilled hole is the tubular wall taper causing the tubular diameter to increase from top to bottom. The inside diameter of the slugger must increase from top end to bottom end so that once the slugger contents move downward through the gate an infinitesimal distance, substantially none of the slugger contents remains in contact with the tubular wall. Once the slugger contents moves downward an infinitesimal distance, the contents are in free fall — this fall as a compact slug, is what enables the blasting composition to achieve the 1.10–1.55 gm/cc inhole density heretofore unknown in bulk hole loading of ammonium nitrate blasting agents.

Without the tapering of the tubular wall as described above, when the slugger is unloaded, it would be impossible to obtain a cohesive compact mass of blasting agent which is necessary to achieve the required density. The taper can be varied — more taper makes the slugger easier to unload, but gives a slug which is not as compact as the slug from the less tapered slugger. The reason for the difference in compactness is because of the feathered leading slug edge when the greater slugger taper is used.

THE DRAWINGS

FIG. 1 shows the slugger 10 with auger 11 positioned thereabove. The slugger can have a collar 12 for catching any improperly directed blasting agent. The slugger can have a vibrator 13 attached thereto having an off-center shaft 17 to start the slug falling once the gate is opened. The gate opening and closing means 14 is shown as a spring 15 loaded pneumatic device, but the device can be any means for opening and closing the gate 16.

Figure 2:
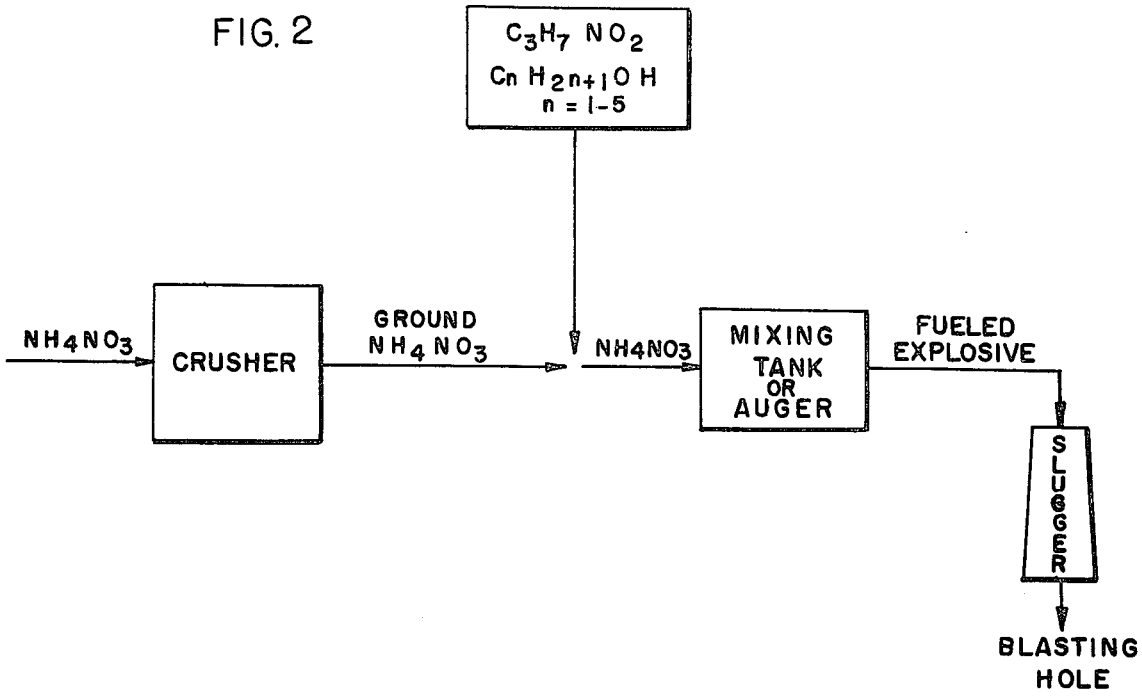

FIG. 2 is a schematic diagram of the composition process, and equipment used in blasting in accordance with the herein described invention.

Figure 3:
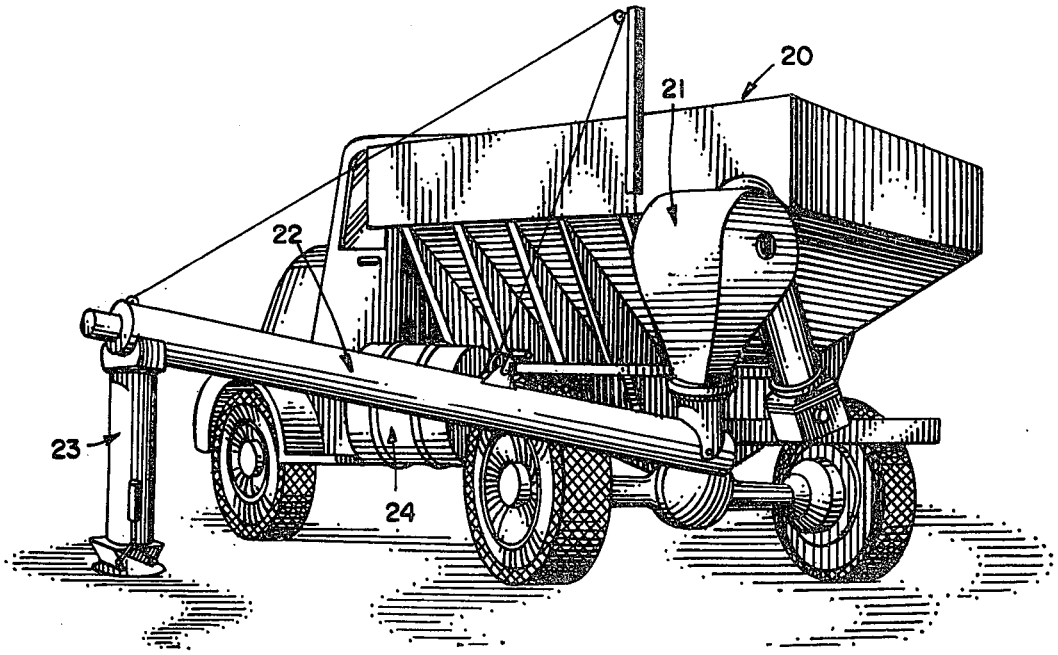

FIG. 3 shows a bulk delivery truck 20 which includes a crusher 21 and auger 22 connected to a slugger 23. The nitropropane, lower alcohol mixture can be stored in tank 24 carried by the bulk delivery truck and mixed with the crushed ammonium nitrate at the intake end of the auger. When not in use, the auger and slugger can be positioned vertically so that the bulk delivery truck need not detach the slugger when travelling on the highway.

One of the major advantages obtained by using the blasting composition described herein is the ability to vary the density at different hole loading heights according to the difficulty of fracturing the particular geological formation at any given height. A higher density slug can be used to blast the more difficulty fractured strata, and a lower density slug for the less difficult strata.

In operations such as strip mining, where ammonium nitrate explosives are commonly used, the layers to be fractured and then shoveled away have sloping walls in accordance with regulations so that the toe or bottom of the earth to be removed is wider than the top or rim where drilling begins. Therefore, the inherent ability to achieve greater densities at the bottom of the hole is very suitable for blasting in the common mining operation. The operator of the slugger can use it in accordance with the invention to drop a high density slug into position for blasting a difficulty fractured or loosened stratum before or after dropping a less dense slug. The less dense slugs can be dropped by simply directing the slug at the inside wall of the hole to break up the slug before it settles, or by leaving the bottom gate partially closed during the drop. The slugger could also simply be used as a funnel, without ever accumulating a slug, to simply pour the blasting agent into the hole to loosen an easily fractured stratum.

In many cases it may be desirable to load the same blast hole to different densities because of varying hardness of rock strata within the hole or because of excessive toe. This can be done by slugging those portions of the hole where greater density and higher detonation pressure is desired and leaving the slugger gate open where the energy requirements are less. Frequently, terrain and other factors such as "driller error" causes hole spacing within a shot to vary somewhat from the shot design, resulting in some holes having greater burden than others. The entire shot can be uniformly loaded by varying the amount of blasting agent per hole, yet maintain the same stemming — this is done by changing the ratio of material loaded as slugs to that loaded with the slugger gate open.

Preferably, the slugger has a vibrator attached thereto. The vibrator 13 (see FIG. 1) has a primary purpose of starting the slug into free fall. The vibrator can be an off-center or cam-type shaft which is motor driven, hand driven, or otherwise rotatable by any means known for turning shafts. For example, a popular commercial vibrator is driven by compressed air. The vibrator helps somewhat in the transition of the blasting composition from the discharge conveyor into the mouth of the slugger and has a slight affect on the inhole density. However, the vibrators main function is to start unloading of the slugger. For this purpose, the vibrator is not essential, since the slug will usually begin to unload with the opening of the gate. And where the slugger taper is so small that the slug does not immediately unload with gate opening, the slugger can be tapped with any object to create enough slugger vibration to begin the unloading process.

The vibrator is not necessary to create the necessary inhole density. Even without the vibrator, when the slug hits the bottom of the predrilled hole, the center of the slug creates a downward force which pushes the blasting composition out against the side wall of the hole. This tight coupling of explosive-to-rock is a necessity for proper shock wave transmission. The importance of explosive-to-rock coupling is well known. Shock wave transmission through annular air space can be as low as 5 percent as effective, and through water, about 75 percent effective.

If lower densities are desired, (1) the slugger gate can be left open and the slugger used as a spout, (2) the slugger can be pointed so that the slug will hit the side wall of the predrilled hole, or (3) the gate can be opened only part way to break up the slug as it emerges from the slugger. However, with these lower inhole densities, the greatest detonation pressure and velocity cannot be obtained as disclosed possible by using the slugger to obtain maximum inhole density.

BLASTING AND ECONOMIC POTENTIAL

To get some idea of the potential of such a blasting agent in field use, consider that an explosive does work in two ways. The work done by an explosive can be expressed in the simple terms of the old Welsh miner — the Hit and the Heave — which was his description of the shock effect created by the sudden application of the detonation pressure and the heaving action of expanding gases.

Ignoring certain factors affecting the machanics of rock failure, the shock effect is transmitted into the surrounding rock in the form of compression and reflected tension waves. If the magnitude of these waves exceeds the compressive and tensile strength of the rock, the rock will fracture. This is followed immediately by the heaving action of the expanding gases, which results in fragmentation along the fractures just created.

For large confined charges, the shock effect is determined by the detonation pressure, while the heaving action is dependent on the volume of gas generated.

The volume of gas generated by an explosive is determined only by its chemical composition, provided the reaction goes to completion. Both AN/FO and a crushed nitrate/nitropropane lower alkanol mix produce nearly 16–½ cu. ft. of gas per pound of material, which is 800 and 1200 times their respective solid state volumes.

If the shock effect is insufficient to fracture between holes an inherent fractures are minimal, the result will be monoliths or large boulder zones, regardless of the volume of expanding gases. Increasing the powder factor might produce the desired fragmentation, but with increased powder and drilling costs and probable excessive displacement.

On the other hand, there is no objection to increased fragmentation if it is a result of increased detonation pressure instead of an increase in powder factor. Or, if present fragmentation is adequate, there should be no objection to reduced drilling and hole loading costs that would result from increased hole spacing necessary to maintain the same powder factor for a high-density blasting agent.

Now consider the field applications of a high-energy, high-density blasting agent that generates the same gas volume as AN/FO when used at the same powder factor, but has a much greater fracturing ability, and can be loaded at varying densities.

The hardest rock strata in any shot determines the hole spacing and powder factor, provided bench heights or thickness of overburden do not impose limits. Generally, proper fragmentation of the hardest strata is accomplished by designing an AN/FO shot to:

a. shoot the hardest strata and overshoot the softer zones;
b. shoot the hardest strata and deck softer zones with drill cuttings;
c. shoot the softer zones and use high-energy booster charges in the harder zones, or;
d. shoot for an average and fight the boulders—too often done.

Of course, if the ground is uniform throughout, blasting technology is quite simple.

The economic possibilies become quite obvious if a high-energy, high-density blasting agent is substituted for AN/FO in the above situations. The savings can be determined from the data that follows.

Without any change in the powder factor or stemming, the savings would be derived from lower drilling costs per cubic yard at increased hole spacing and, with less holes, there would be savings in hole loading costs, primers, supplies, repairs, etc. Further, there is considerable savings resulting from better fragmentation which increases drag line or shovel efficiency and reduces milling costs.

As noted in the example that follows, the savings in drilling and blasting costs can be far greater than the increased cost of the blasting agent—in fact, in some cases, the savings can be as large as the present cost of blasting agent.

TO DETERMINE TOTAL SAVINGS IN DRILLING AND BLASTING COSTS

The saving in drilling and blasting costs alone, can, in many cases, be greater than the present cost of blasting agent when a high-energy, high-density blasting agent, as described herein, is used to replace AN/FO. At the same powder factor, hole size and stemming, the savings can be calculated from the following:

$$\$ = ¢ \quad \left[ - \frac{(¢BA)}{PF} f + \frac{(BA/NP)}{PF} \right]$$

where $ is the savings in ¢ per cu. yd. (or ton)

¢ is present drilling and blasting cost in ¢ per cu. yd. (or ton)

BA is present blasting agent cost in ¢ per pound

PF is the powder factor in cu. yds./lb. (or tons/lb)

BA/NP is cost of blasting agent containing nitropropane in ¢ per pound

*f* is an "expansion" factor for the new increased hole spacing resulting from increased density — 100 percent increase in cu. yd. (or tons) per foot of hole, *f* is 0.50; for a 75 percent increase, *f* is 0.57; for 50 percent increase, *f* is 0.67, etc.

While a preferred embodiment of the invention has been shown, it is to be understood that numerous modifications and changes will occur to those skilled in the art. The appended claims are intended to encompass all such modifications and changes as come within the true spirit and scope of the invention.

What is claimed as new and desired to be secured by Letters Patent of the United States is:

1. A blasting agent having a density of 1.10 to 1.55 gm/cc. comprising crushed ammonium nitrate, 1–17% by weight nitropropane and 1–17% by weight of alkanol having 1 to 5 carbon atoms, wherein the combined weight percentage of nitropropane plus alkanol is 10–18%.

2. A blasting agent as defined in claim 1 wherein the ammonium nitrate is high density, low porosity cake ammonium nitrate.

3. A blasting agent as defined in claim 1 wherein the ammonium nitrate is high density, high porosity prilled ammonium nitrate.

4. A blasting agent as defined in claim 1 wherein the ammonium nitrate is low density, high porosity prilled ammonium nitrate.

5. A blasting agent as defined in claim 1 wherein less than 60 percent of the ammonium nitrate has a particle size greater than 20 mesh.

6. A blasting agent as defined in claim 1 wherein the nitropropane is present in an amount of 5–9 percent by weight and wherein the alkanol is present in an amount of 5–9 percent by weight.

7. A blasting agent as defined in claim 1 wherein the oxygen balance is substantially zero.

8. The blasting agent of claim 1 wherein less than 7 percent of said ground ammonium nitrate has a particle size greater than 20 mesh.

9. The blasting agent of claim 1 wherein the nitropropane consists essentially of 2-nitropropane and wherein said alkanol consists essentially of methanol.

10. A blasting agent as defined in claim 1 which is not cap-sensitive.

* * * * *